US008082694B2

(12) United States Patent
Azuma

(10) Patent No.: US 8,082,694 B2
(45) Date of Patent: Dec. 27, 2011

(54) CABLE GUIDE

(75) Inventor: Chiharu Azuma, Takarazuka (JP)

(73) Assignee: Hi-Lex Corporation, Hyogo (JP)

( * ) Notice: Subject to any disclaimer, the term of this patent is extended or adjusted under 35 U.S.C. 154(b) by 926 days.

(21) Appl. No.: 12/045,109

(22) Filed: Mar. 10, 2008

(65) Prior Publication Data

US 2008/0244982 A1 Oct. 9, 2008

(30) Foreign Application Priority Data

Mar. 9, 2007 (JP) ..... 2007-060120

(51) Int. Cl.
*E05F 11/00* (2006.01)

(52) U.S. Cl. ..... 49/360; 49/352

(58) Field of Classification Search ..... 49/352, 49/360; 296/155; 242/579, 585, 586, 586.2, 242/587, 587.2; 254/402, 403, 409, 411
See application file for complete search history.

(56) References Cited

U.S. PATENT DOCUMENTS

| | | | | | |
|---|---|---|---|---|---|
| 3,280,509 | A | * | 10/1966 | Werner | 49/352 |
| 4,313,282 | A | * | 2/1982 | Hagemann et al. | 49/352 |
| 4,615,234 | A | * | 10/1986 | Chevance et al. | 74/501.5 R |
| 4,630,398 | A | * | 12/1986 | Schust | 49/352 |
| 4,631,864 | A | * | 12/1986 | Barros | 49/352 |
| 4,657,523 | A | * | 4/1987 | Chevance et al. | 474/101 |
| 5,207,116 | A | * | 5/1993 | Sultze | 74/502.4 |
| 5,598,743 | A | * | 2/1997 | Yasuda | 74/502.4 |
| 5,682,797 | A | * | 11/1997 | Kelley et al. | 74/502.4 |
| 5,749,174 | A | * | 5/1998 | Mariel | 49/352 |
| 5,884,433 | A | * | 3/1999 | Watanabe et al. | 49/360 |
| 6,026,611 | A | * | 2/2000 | Ralston et al. | 49/123 |
| 6,202,351 | B1 | * | 3/2001 | Medebach | 49/352 |
| 6,216,555 | B1 | * | 4/2001 | Malone | 74/502.6 |
| 6,408,572 | B1 | * | 6/2002 | Uchimura et al. | 49/352 |
| 6,574,922 | B2 | * | 6/2003 | Velthaus et al. | 49/352 |
| 6,866,250 | B2 | * | 3/2005 | Kita | 254/225 |
| 7,334,498 | B2 | * | 2/2008 | Yokomori et al. | 74/502.4 |
| 7,823,329 | B2 | * | 11/2010 | Stahn et al. | 49/352 |
| 2005/0016071 | A1 | * | 1/2005 | Takeda et al. | 49/352 |
| 2009/0078505 | A1 | * | 3/2009 | Casebolt et al. | 182/231 |

FOREIGN PATENT DOCUMENTS

| | | |
|---|---|---|
| JP | 2002194945 | 7/2002 |
| JP | 2003328639 | 11/2003 |

* cited by examiner

*Primary Examiner* — Jerry Redman
(74) *Attorney, Agent, or Firm* — Browdy and Neimark, PLLC

(57) ABSTRACT

A cable guide which has a simple structure and can be easily assembled is adapted to change the direction of the inner cable which slide and drive the slide door of a vehicle, and includes a pulley case 11 whose upper surface is opened, a pulley 12 housed in the pulley case and pivoted rotatably, and a case cover 13 to cover the upper surface of the pulley case. The pulley case has a fixing portion 15 of the outer casing which slidably houses an inner cable. The fixing portion has grooves of roughly U-shaped cross section. The inner perimeter of the groove has a case protrusion 15*a*. A cover protrusion 13*e* is formed in the case cover so as to face the case protrusion.

5 Claims, 7 Drawing Sheets

PRIOR ART

CABLE GUIDE

FIELD OF THE INVENTION

This invention relates to a cable guide to change the direction of an inner cable, more specifically, to a cable guide for a cable to slide a slide door of vehicles such as automobiles, small crafts.

BACKGROUND ARTS

Patent Document 1: Japanese Published Patent Application No. 2003-328639

Patent Document 2: Japanese Published Patent Application No. 2002-194945

In FIG. 9, the case of Patent Document 1 is shown. The case 100 shown in FIG. 9 comprises two case members 101, 102. The lower case member 102 has a space 103 to house a pulley, and the upper portion of the space 103 is covered by the case member 101. In the side of the lower case member 102, a lead-in opening 102*a* is formed, where an outer tube 104 is latched. In the front end of the outer tube 104, a tube end 104*a* is provided, the annular groove portion of the tube end 104*a* is held by the lead-in opening 102*a* and the upper surface of the case member 101.

In FIG. 10, a cable holder of Patent Document 2 is shown. The cable holder 110 shown in FIG. 10 comprises a cable guide bracket 111 having a notched groove 111*a*, and a halved retainer 112 composed of a pair of hinged closable half-bodies 112*a*, 112*a* for tucking and fixing an outer cable (outer casing) 113. In the inner surface of the retainer 112, a convexoconcave portion 112*c* to fix the outer cable 113 is formed. In the free end of the hinged closable half bodies 112*a*, 112*a*; claws 112*b*, 112*b* for engaging with the notched grooves 111*a* are formed extending outwardly. To make the cable holder 110 support the outer cable 113, the outer cable 113 is tucked down into the hinged closable half bodies 112*a*, 112*a*. Then, while the both side of the hinged closable half bodies 112*a*, 112*a* are pinched by fingers to tuck the outer cable 113, the claws 112*b*, 112*b* to prevent the dropping are inserted into the notched groove 111*a*.

DISCLOSURE OF THE INVENTION

Problem to be Resolved by the Invention

In Patent Document 1, it is necessary to use the tube end 104*a* for coupling the outer tube 104 and the case 100, which makes the number of parts many. Moreover, before closing by the case member 101, since the groove portion formed in the tube end 104*a* is only inserted into the lead-in opening 102*a* of the case member 102, it ends up dropping out easily.

Further, in Patent Document 2, it is made so that the end of the outer cable 113 is built in the cable guide bracket 111 after being supported by the convexoconcave portion 112*c*. However, when it is built in the cable guide bracket 111, while the outer casing is held by fingers, the hinged closable half bodies 112*a*, 112*a* are subject to open on a sudden, and it leads the outer cables to falls down, which makes it difficult to build in.

Therefore, this invention provides a cable guide which has a simple structure and can be easily assembled.

Means of Solving the Problems

The cable guide of this invention is a cable guide to change a direction of an inner cable, where the inner cable for sliding a slide door of a vehicle body. The cable guide comprises a pulley case of a box shape having an upper surface, the upper surface is opened, a pulley pivotably mounted and housed in the pulley case, and a case cover covering the upper surface of the pulley case. Further the pulley case includes a fixing portion having a groove of U-shaped cross section, where the groove for fixing a vicinal end of an outer casing, the outer casing slidably houses the inner cable. More, the cable guide further comprises a case protrusion formed on an inner perimeter of the groove for fixing the outer casing by biting the outer casing, and a cover protrusion formed on the case cover facing the case protrusion, the cover protrusion forces the outer casing to bite the case protrusion.

In such cable guide, it is preferable that the case protrusion is plural of U-shaped protruding lines arranged axially in parallel on the inner perimeter of the groove.

Effects of the Invention

In the cable guide of this invention, it is possible to make the vicinal end of the outer casing bite into the case protrusion in order to latch to the groove of the fixing portion. Therefore, it is possible to keep the end of the outer casing being temporarily tacked to the groove of the fixing portion while in assembling work, even a worker unlink his hands from the outer casing. Resulting the assembling work is easy. Moreover, after the case cover is arranged to cover the upper surface of the pulley case, the outer casing can be latched strongly because the cover protrusion depresses or forces the outer casing so as to bite into it.

In the cable guide where the case protrusion is plural of U-shaped protruding lines arranged axially in parallel on the inner perimeter of the groove, the latch of the outer casing becomes further secure. Because, the protruding lines bite in from the bottom and the both sides of the outer casing.

BEST MODE FOR CARRYING OUT THE INVENTION

Next, the embodiments of the cable guide of this invention are described referencing the drawings

Figure 2:
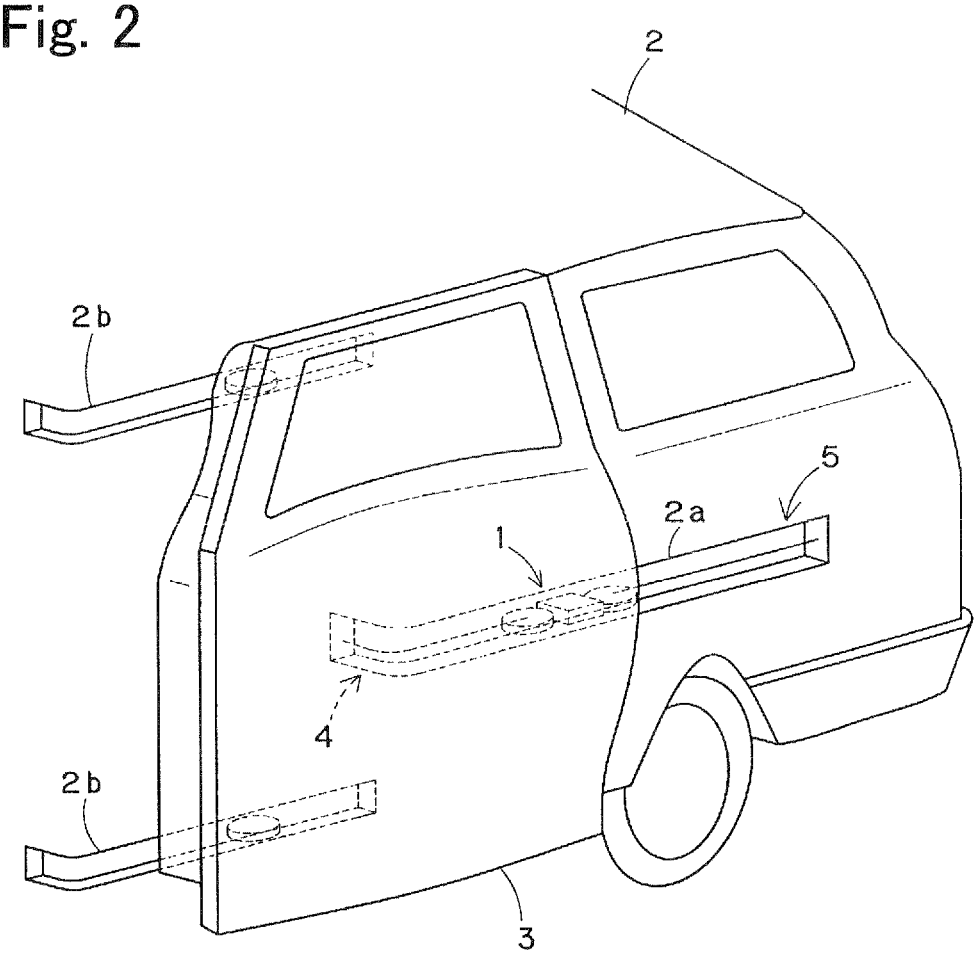
FIG. 2 is an outline partial perspective view showing a vehicle body for which the cable guide shown in FIG. 1 is used.

First, referencing FIG. 2, the power slide door unit for which the cable guide of this invention is used is described. The power slide door unit 1 shown in FIG. 2 is used for, for example, a one-box type vehicle body 2 etc. In the side of the vehicle body 2, a door 3 is provided. The door 3 slides along rails (center rail 2*a*, upper and lower rails 2*b*, 2*c*) provided in the center of the vehicle body, and the upper and lower ends of the vehicle body.

Figure 3:
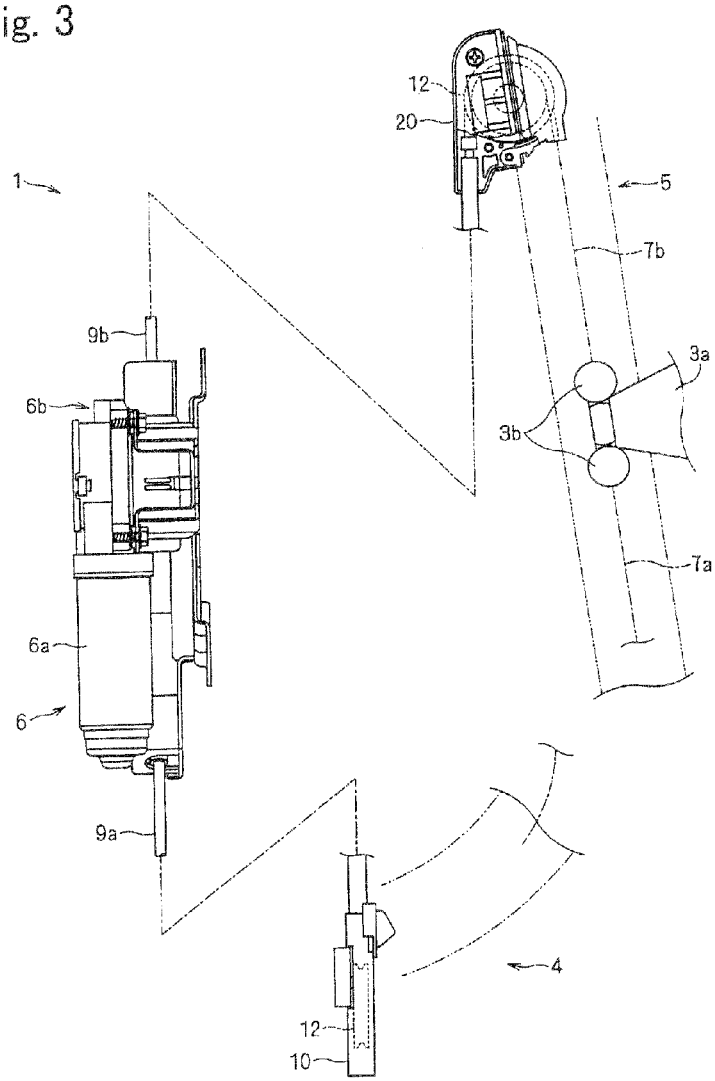
FIG. 3 is an outline cabling diagram showing a power slide door unit equipped with the cable guide of FIG. 1.

From hence, further detailed description is made referencing FIG. 3. The power slide door unit 1 shown in FIG. 3 is arranged in the vicinity of a center rail 2*a* located in the vicinity of center of the vehicle body 2. The vicinity of the front end 4 of the center rail 2*a* is bent toward the inside of the vehicle, and the vicinity of the rear end 5 is extended straight. An arm 3*a* to attach the door 3 is arranged slidably. In the arm 3*a*, a roller 3*b* etc. to roll in the center rail 2*a* is rotatably attached between the front and the rear end of the center rail 2*a*. In the arm 3*a*, the end of the inner cable 7*a* to move the door 3 forward and the end of the inner cable 7*b* to move the door 3 backward are attached. These inner cables 7*a*, 7*b* extend along the center rail 2*a* in the exterior of the vehicle body 2.

Moreover, a front cable guide 10 to change the direction of the inner cable is attached to the outer wall of the vehicle body 2 of the vicinity of the front end of the center rail 2*a*. In the front cable guide 10, a pulley 12 is pivoted so that its axis of rotation is directed to the right and left direction of the vehicle. And, the inner cable 7*a* for forward movement passes through a hole formed in the outer wall of the vehicle, enters into the interior of the vehicle body, after being turned around by the pulley 12, it is guided to the drive portion 6 by the front outer casing 9*a*. On the other hand, a rear cable guide 20 is attached in the vicinity of the rear end 5. In the rear cable guide 20, the pulley 12 is arranged and pivoted so that its axis of rotation is directed perpendicular to the right and left direction of the vehicle. And, the inner cable 7*b* for backward movement passes through a hole formed in the outer wall of the vehicle, enters into the interior of the vehicle, and after being turned around by the pulley 12, it is guided to the drive portion 6 by the front outer casing 9*b*.

The drive portion 6 has a drum (not shown in the figure) to reel off the other end of the inner cable 7*a*, 7*b* for forward movement and backward movement and to reciprocate cyclically the loop of the inner cable by winding back, a motor 6*a* to rotatably drive the drum, a clutch (not shown in the figure) to transmit the drive or to release the transmission, and a speed reducer 6*b*. In this embodiment, the drive portion 6 is arranged sideways. Those drive portion 6 and the outer casing 9*a*, 9*b* are housed in the panel of sidewall of an automobile.

Figure 1:
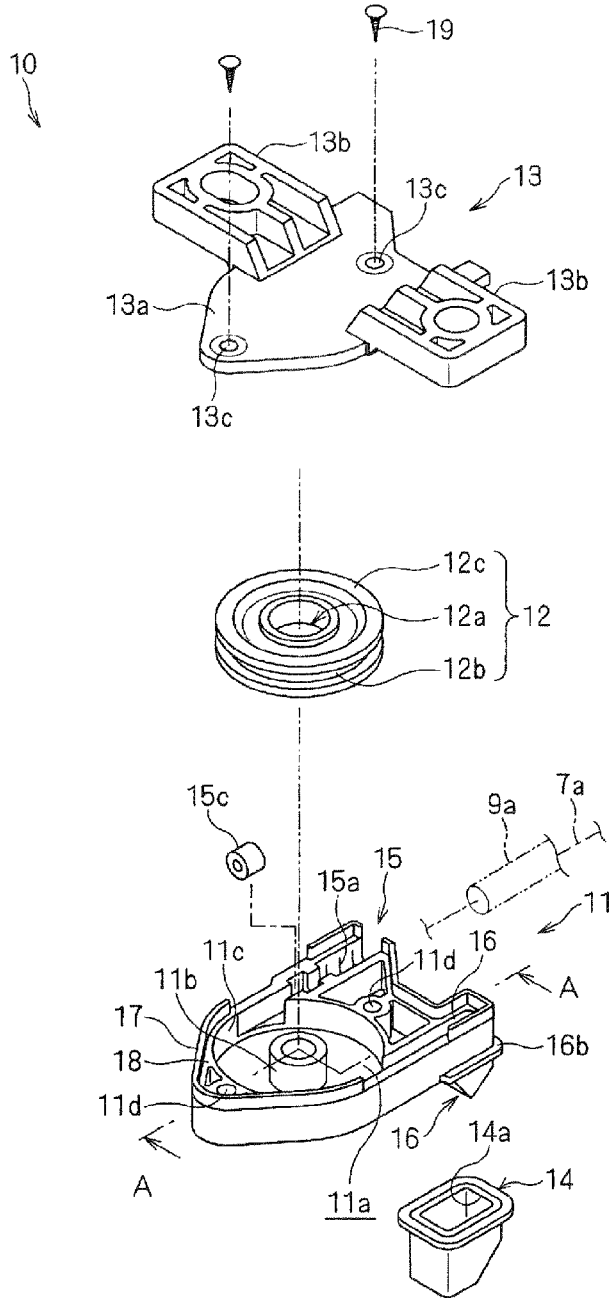
FIG. 1 is a breakdown perspective view showing an embodiment of the cable guide of this invention.

The front cable guide 10 shown in FIG. 1 comprises a pulley case 11, a pulley 12 pivoted in the pulley case, a case cover 13 to cover the upper surface of the pulley 12, and a front grommet 14 provided in the outer perimeter of the pulley case 11.

The pulley case 11 has a bottom 11*a* in its interior on which the lower surface of the pulley 12 slides, a cylindrical portion 11*b* protruding from about the vicinity of the center of the bottom 11*a* and pivots the pulley 12 rotatably, a standing wall 11*c* provided to stand upward from the side edge of the bottom 11*a* and arranged closely to the side peripheral surface of the pulley 12. In the outside of the standing wall 11*c*, tightening holes 11*d*, 11*d* are arranged.

Moreover, in the back of the standing wall 11*c*, a fixing portion 15 which leads the inner cable 7*a* for forward movement to the drive portion 6 side (see FIG. 3) penetrating the standing wall 11*c*, and fixes the tail end of the front outer casing 9*a* is formed at the same time. The fixing portion 15 has a groove whose cross section is roughly U-shaped, and a plurality of case protrusions (protruding lines 15*a*, 15*a* . . . ) extending in the hoop direction in the inner periphery surface of the groove is arranged axially in parallel. The length of the U-shaped groove is 10-15 mm, and is preferably 11-13 mm. The protruding line 15*a* formed in the inner periphery surface of the U-shaped groove is 0.2-0.5 mm in height, preferably 0.3-0.4 mm, and is 02.-0.5 mm in width, preferably 0.3-0.4 mm, and the number is 2-5, preferably 2-4. Further, between the fixing portion 15 and the standing wall 11*c*, a recessed portion to house a cylindrical elastic member 15*c* is provided. The elastic member 15*c* makes the inner cable 7*a* coming out from the front outer casing 9*a* pass through therein while elastically housing it. The elastic member 15*c* prevents the introduction of water or dust into the pulley case 11. As the material of the elastic member 15*c*, rubber, rubber-based resin or elastomer etc., preferably silicon rubber are used.

The shape of the protruding line 15 may be keen-edged chevron or a plurality of sharp protrusions directed to the front edge so as to bite into the front outer casing 9*a* deeply. Further, it is preferable that the protruding line 15 has a shape which completely surrounds the circumference of the outer casing 9 in order to increase the contact portion. Further, it may be provided with a barb such as being formed in a fish hook so as to constrain the direction of dropping out, and to prevent the once inserted front outer casing 9*a* from moving toward the direction to drop out. In addition, the protruding line 15 is preferable to have a shape being easy for molding, the protruded portion may be formed only in the protruding line 15 of the U-shaped bottom portion.

Figure 4:
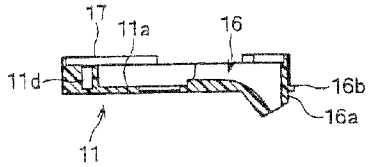
FIG. 4 is an A-A line cross section of FIG. 1.

On the other hand, a guide path 16 penetrating the standing wall 11*c* is formed nearly in parallel with the fixing portion 15 under the fixing portion 15. The guide path 16 guides the inner cable 7*a* for forward movement turned around by the pulley 12 to the outside of the vehicle. The guide path 16 is equipped with a jut 16*a* (see FIG. 4) whose front edge extends toward the outside of the vehicle gradually bending backward (bottom 11*a* side). Moreover, a flange portion 16*b* extends around the periphery of the jut 16*a* (see FIG. 4).

The upper surface side including the standing wall 11*c* of the pulley case 11, the fixing portion 15, the guide path 16, and the tightening holes 11*d* is formed to be one plane. A periphery wall 17 is provided to stand upward along the outer periphery of the pulley case 11 from the plane 18 formed to be one plane. The extension of the periphery wall 17 makes the plane 18 of one plane be like shoulder. The pulley case 11 is preferable to be integrally formed of synthetic resin etc., and as the synthetic resin, polyester, polyamide (PA) or polyoxymethylene (POM), preferably polybutyleneterephthalate (PBT) are used.

The case cover 13 has a lid portion 13*a*, brackets 13*b*, 13*b* extending upward and downward from the lid portion which cover the upper surface of the bottom 11*a*, the fixing portion 15, and the guide path 16. And, in the lid portion 13*a*, holes 13*c*, 13*c* are formed at the position corresponding to the position of the tightening holes 11*d* of the pulley case. Since the lid portion 13*a* is fitted in along the inner periphery of the periphery wall 17, the assembling is easy. And, the rear surface of the case cover 13 just contacts the plane 18 of one plane of the pulley case 11, a tightening member 19 such as screw is tightened from the holes 13*c* of the upper surface of the lid portion 13*a* to the tightening holes 11*d*.

Figure 5:
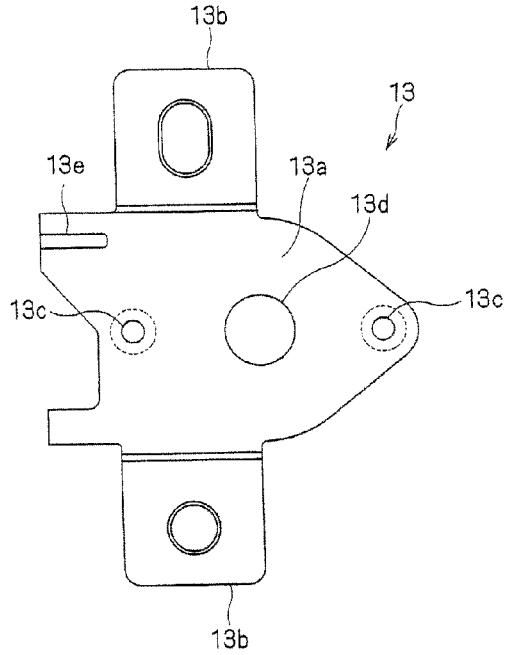
FIG. 5 is a back view of the case cover of FIG. 1.

Moreover, in the center portion of the rear surface of the lid portion 13*a* shown in FIG. 5, a recessed concave portion 13*d* is formed, and the front edge of the cylindrical portion 11*b* of the pulley case 11 is arranged. Further in the portion corresponding to the fixing portion 15 of the pulley case 11 in the rear of the lid portion 13*a*, a cover protrusion (protrusion 13*e*) of slender rectangular shape which extends toward the axial direction of the outer casing 9*a* and protrudes toward the protruding lines 15*a* of the fixing portion 15 is formed. The protrusion 13*e* fixes the end of the outer casing 9*a* (see FIG. 1)

for forward movement along with the protruding lines 15*a*. The protrusion 13*e* is 0.2-0.5 mm in height, preferably 0.3-0.4 mm, 8-15 mm in length, preferably 9-12 mm, 2-5 mm in width, preferably 2-3 mm. As the material of the case cover 13, polyester, polyamide (PA) or polyoxymethylene (POM), preferably polybutyleneterephthalate (PBT) are used.

Returning to FIG. 1, the pulley 12 comprises an opening 12*a* for being pivoted by the cylindrical portion 11*b* of the pulley case 11 formed in its center portion, and a guide groove 12*b* to guide the inner cable 7*a* for forward movement formed in its vicinity of the center of the periphery side. The perimeter of the opening portion 12*a* pivoted by the cylindrical portion 11*b* of the center of the pulley 12 presents a raised cylindrical shape, the cylindrical upper and lower end surfaces are tucked down by the bottom 11*a* of the pulley case 11 and the rear of the lid portion 13*a* of the case cover, and is slidable. The shoulder 12*c* formed in the further outside of the radius direction from the raised portion of the opening 12*a* of the pulley 12 is arranged with a slight clearance to the bottom 11*a* of the pulley case 11 and the rear of the lid portion 13*a* of the case cover 13. Thereby, the stable rotation of the pulley 12 is kept. Between the outer perimeter of the pulley 12 and the standing wall 11*c* of the pulley case 11, it prevents the dropping out of the inner cable 7*a* for forward movement from the guide groove 12*b* since a clearance smaller than the diameter of the inner cable 7*a* for forward movement is formed. As the material of the pulley 12, polyoxymethylene (POM), polyester or polyamide (PA), preferably polyoxymethylene (POM) are used.

Figure 6:
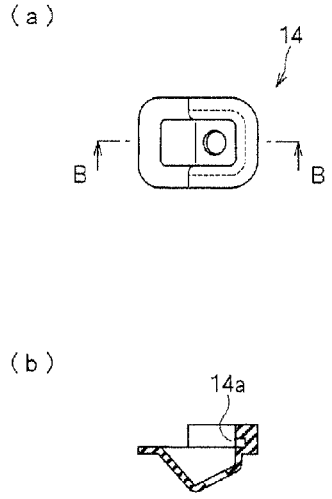
FIG. 6*a* is a front view of a grommet.
FIG. 6*b* is a B-B line cross section of FIG. 6*a*.

The front grommet 14 shown in FIG. 6 is attached by engaging an engaging groove 14*a* with the flange portion 16*b* of the jut 16*a* of the pulley case 11 (see FIG. 1). And, it is arranged so as to cover the outer perimeter of the jut 16*a* to prevent water and dust to infiltrate into the inside of the pulley case 11 from the outside of the vehicle. As the material for the grommet 14, rubber, rubber-based resin, preferably chloroprene rubber (CR) are used.

Figure 7:
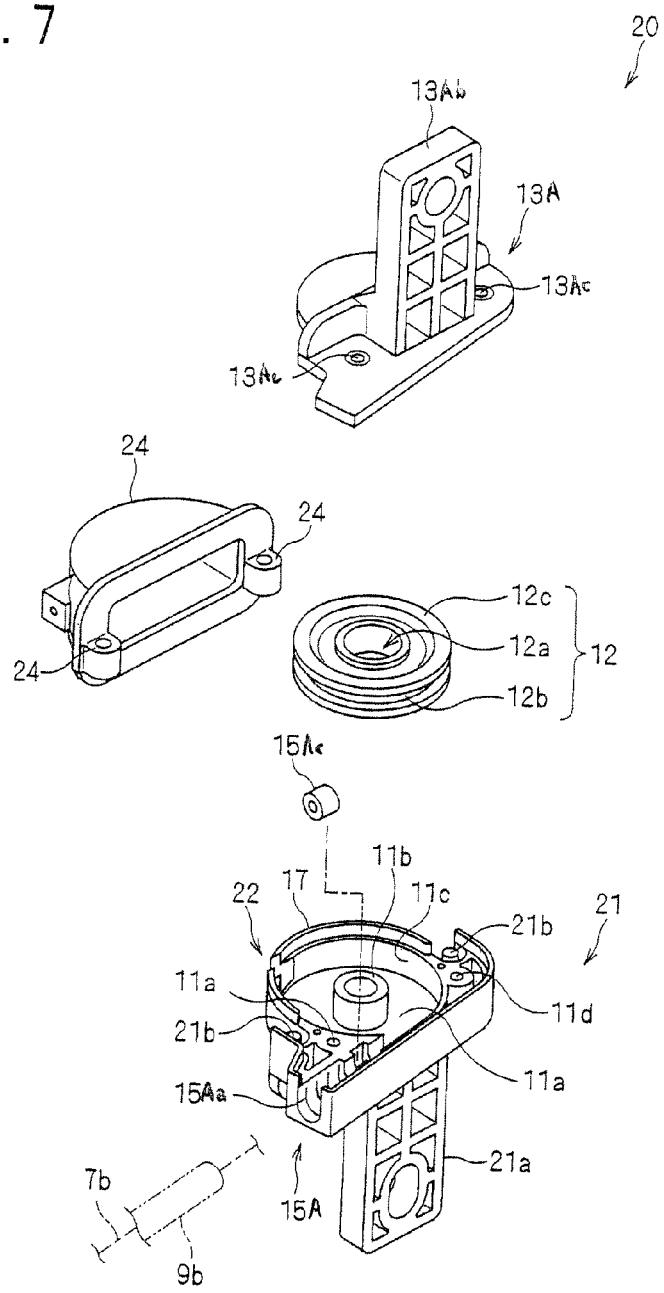
FIG. 7 is a breakdown perspective view showing the other embodiment of the cable guide.

In FIG. 7, a rear cable guide 20 is shown. Since this has the similar portion to the front cable guide 10, the description of the same portion given the same reference numeral is omitted. The rear cable guide 20 comprises a pulley case 21, a pulley 12 pivoted in the pulley case, a case cover 23 covering the upper surface of the pulley 12, a rear grommet 24 provided in the outer perimeter of the pulley case 21.

The pulley case 21 has a bottom 11*a* in its interior on which the lower surface of the pulley 12 slides, a cylindrical portion 11*b* which protrudes from about the vicinity of the center of the bottom 11*a* and pivots the pulley 12 rotatably, and a standing wall 11*c* provided to stand upward form the vicinity of the side edge of the bottom 11*a* and arranged closely to the side peripheral surface of the pulley 12. In the outside of the standing wall 11*c*, tightening holes 11*d*, 11*d* are arranged. In the backside of the standing wall 11*c*, a fixing portion 15A which leads the inner cable 7*b* for backward movement to the drive portion 6 side (see FIG. 3) penetrating the standing wall 11*c*, and fixes the tail end of the rear outer casing 9*b* at the same time is formed. The fixing portion 15A has a groove whose cross section is roughly U-shaped, and has a plurality of case protrusions (protruding lines 15Aa, 15Aa . . . ) extending in the hoop direction in the inner periphery surface of the groove.

In the pulley case 21, a guide hole 22 communicating with the outside of the vehicle 2 is formed penetrating the standing wall 11*c*. And, the inner cable 7*b* introduced from the fixing portion 15A is extended outward from the guide hole 22 formed in the standing wall 11*c* after being turned around by the pulley 12. In the rear of the pulley case 21, a bracket 21*a* which is an attaching portion to the vehicle is formed. Moreover, also to the outside surface of the case cover 23, the brackets 13Ab extend outward. In addition, a pair of support rods 21*b*, 21*b* is formed, in the outside of the standing wall 11*c* of the pulley case 21. When the case cover 23 is fixed, the inside of the case cover 23 is arranged just on the upper surface of the support rods 21*b*.

Figure 8:
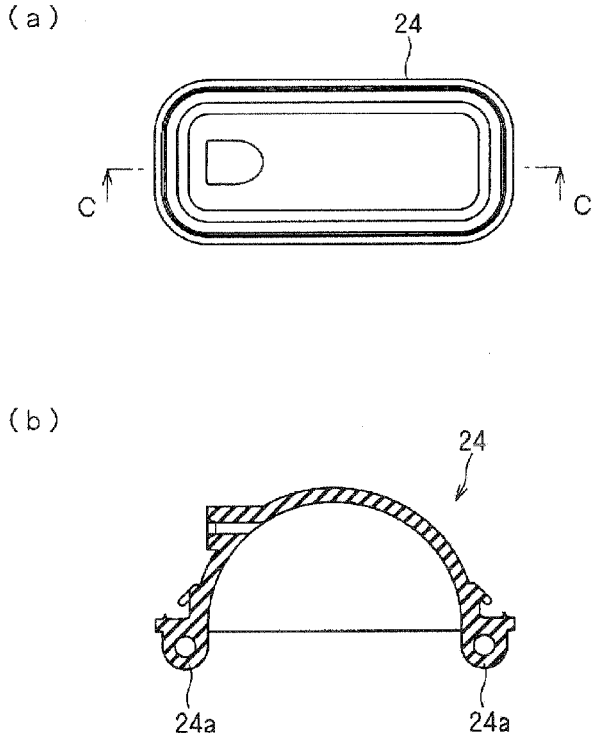
FIG. 8*a* is a front view of the grommet of FIG. 7.
FIG. 8*b* is a C-C line cross section of FIG. 8*a*.
Figure 9:
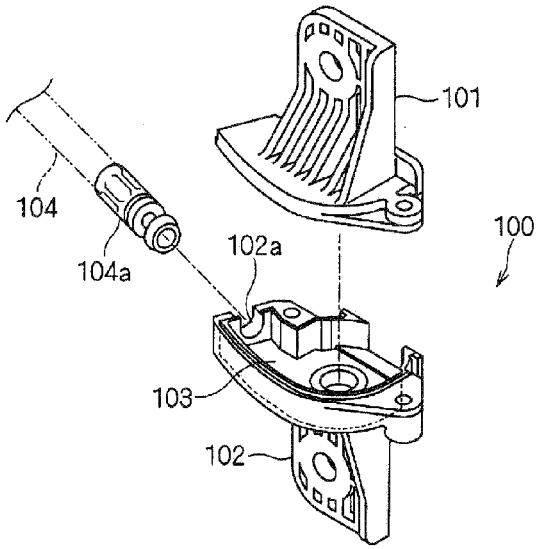
Fig. 9 Prior Art
FIG. 9 is an outline drawing showing the prior art.
Figure 10:
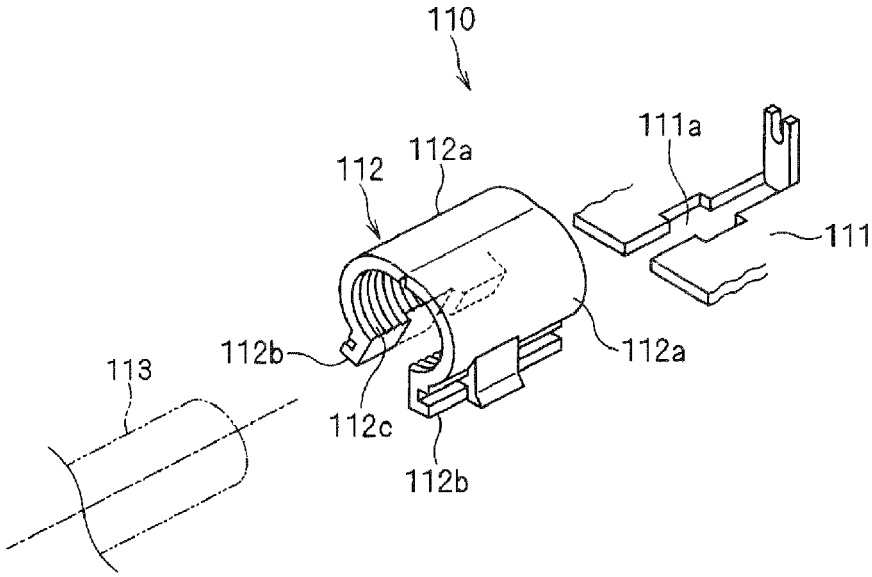
Fig. 10 Prior Art
FIG. 10 is an outline drawing showing another prior art.

The rear grommet 24 shown in FIG. 7 and FIG. 8 is equipped with fitting pieces 24*a*, 24*a* which can be fitted in the support rods 21*b*, 21*b* of the pulley case 21. It is arranged so as to cover nearly whole of the portion protruding outside of the vehicle of the pulley case 21. It prevents the infiltration of water and dust into the inside of the pulley case from the outside of the vehicle. In addition, the attachment of the rear grommet 24 to the pulley case 21 may the attachment of the flange portion 16*b* and the engaging groove 14*a* such as the front grommet 14 and the pulley case 11.

By pushing in the front end of the outer casing 9*a*, 9*b* toward the protruding lines 15Aa, 15Aa. . . , the arranging of the pulley case 12 and the case covers 13A, 23 is easy, since the temporal tacking of the outer casing 9*a*, 9*b* is possible.

The invention claimed is:

1. A cable guide (10, 20) to change direction of an inner cable (7*a*, 7*b*), the inner cable (7*a*, 7*b*) being for sliding a slide door (3) of a vehicle body, comprising;

a pulley case (11, 21) of a box shape having an open upper end;

a pulley (12) pivotably mounted and housed in the pulley case (11, 21) and having a bottom surface and a side peripheral surface; and a case cover (13A,) covering the upper open end of the pulley case (11, 21);

wherein the pulley case (11, 21) comprises;

a bottom (11*a*) on which the bottom surface of the pulley (12) slides;

a cylindrical portion (11*b*) protruding from the bottom (11*a*) about which the pulley (12) rotates;

a side wall (11*c*) provided to stand upward from a side edge of the bottom (11*a*) and arranged closely to the side peripheral surface of the pulley (12);

a fixing portion (15, 15A) having a penetrating hole which penetrates the side wall (11*c*) and having a groove of U-shaped cross section, the groove for fixing a vicinal end of an outer casing slidably housing the inner cable;

a guide path (16) or a guide hole (22) penetrating the side wall 11*c*;

wherein a case protrusion (15*a*, 15Aa) is formed on an inner perimeter of the groove for fixing the outer casing (9*a*, 9*b*), in which the case protrusion (15*a*, 15Aa) bites the outer casing (9*a*, 9*b*) when the outer casing (9*a*, 9*b*) is fixed to the fixing portion, wherein a cover protrusion (13*e*) is formed on the case cover (13, 13A) facing the case protrusion (15*a*), wherein the cover protrusion (13*e*) forces the outer casing (9*a*, 9*b*) to bite the case protrusion (15*a*, 15Aa) when the pulley case (11,21) which is fixed with the outer casing (9*a*, 9*b*) and the case cover (13, 13A) is fixed together.

2. A cable guide according to claim 1, wherein the case protrusion (15*a*, 15Aa) is plural of U-shaped protruding lines (15*a*, 15Aa) arranged axially in parallel on the inner perimeter of the groove.

3. A cable guide according to claim 1, wherein the case protrusion (15*a*, 15Aa) is extended in the hoop direction in the inner periphery surface of the groove.

4. A cable guide according to claim 1, wherein a cover protrusion (13*e*) has slender rectangular shape which extends toward the axial direction of the outer casing (9*a*).

5. A cable guide according to claim 1, wherein the pulley case (11, 21) further comprises a periphery wall (17) provided upward from a plane (18) formed of upper surface side of the standing wall (11*c*), the fixing portion (15, 15A), and the guide path (16), and provided to stand upward along the periphery of the pulley case (11, 21); wherein the case cover (13, 13A) has a lid portion (13*a*, 13Aa) which covers the plane (18) and is fitted in along the inner periphery of the periphery wall (17).

* * * * *